US006102099A

United States Patent [19]

Sturgis et al.

[11] Patent Number: 6,102,099

[45] Date of Patent: Aug. 15, 2000

[54] METHOD FOR IMAGING INCLUSIONS IN INVESTMENT CASTINGS

[75] Inventors: David Howard Sturgis, Boring; James R. Barrett, Milwaukie; Mark E. Springgate, Portland; Mehrdad Yasrebi, Clackamas, all of Oreg.; Douglas G. Nikolas, Battleground, Wash.

[73] Assignee: PCC Structurals, Inc., Portland, Oreg.

[21] Appl. No.: 09/212,116

[22] Filed: Dec. 15, 1998

Related U.S. Application Data

[60] Provisional application No. 60/069,597, Dec. 15, 1997.

[51] Int. Cl.[7] ..... B22C 1/02; B22C 9/04

[52] U.S. Cl. ..... 164/4.1; 164/517; 164/519; 164/523; 164/529

[58] Field of Search ..... 164/4.1, 24, 150.1, 164/517, 519, 523, 529; 106/38.2, 38.22, 38.27, 38.9

[56] References Cited

U.S. PATENT DOCUMENTS

| | | | |
|---|---|---|---|
| 3,422,880 | 1/1969 | Brown et al. | 164/517 |
| 3,617,747 | 11/1971 | Wilkinson et al. | 164/4.1 X |
| 4,040,845 | 8/1977 | Richerson et al. | 106/38.9 |
| 5,242,007 | 9/1993 | Remmers et al. | 164/4.1 |
| 5,643,844 | 7/1997 | Yasrebi et al. | 106/38.9 X |
| 5,975,188 | 11/1999 | Lassow et al. | 164/4.1 X |

FOREIGN PATENT DOCUMENTS

| | | | |
|---|---|---|---|
| 55-114441 | 9/1980 | Japan | 164/519 |
| 3-8533 | 1/1991 | Japan | 164/519 |
| 508324 | 5/1976 | U.S.S.R. . | |

OTHER PUBLICATIONS

"Standard Practices for Thermal Neutron Radiography of Materials1," American Society for Testing and Materials, Designation E 748–95, 1995.

Neutron Radiography, by Aerotest Operations, Inc. (1997).

*Primary Examiner*—J. Reed Batten, Jr.

*Attorney, Agent, or Firm*—Klarquist Sparkman Campbell Leigh & Whinston, LLP

[57] ABSTRACT

A metal or metal alloy article is cast using an investment casting mold where the mold facecoat, and perhaps one or more of the mold backup layers, comprises an imaging agent distributed substantially uniformly throughout in amounts sufficient for imaging inclusions. The facecoat preferably comprises an intimate mixture of a refractory material and the imaging agent. Intimate mixtures can be produced in a number of ways, but a currently preferred method is to cocalcine the refractory material, such as yttria, with the imaging agent, such as gadolinia. The facecoat also can comprise plural mold-forming materials and/or plural imaging agents. The difference between the linear attenuation coefficient of the article and the linear attenuation coefficient of the imaging agent should be sufficient to allow imaging of the inclusion throughout the article. The metal or metal alloy article is then analyzed for inclusions by N-ray analysis. The method also can include the step of analyzing the metal or metal alloy by X-ray analysis. The imaging agent, typically a metal oxide or salt, comprises a material selected from the group consisting of boron, neodymium, samarium, europium, gadolinium, dysprosium, holmium, erbium, ytterbium, lutetium, iridium, physical mixtures thereof and chemical mixtures thereof.

61 Claims, 3 Drawing Sheets

METHOD FOR IMAGING INCLUSIONS IN INVESTMENT CASTINGS

CROSS REFERENCE TO RELATED APPLICATION

The present application claims priority from copending provisional application, No. 60/069,597, filed on Dec. 15, 1997, which is incorporated herein by reference.

FIELD OF THE INVENTION

This invention concerns methods for making investment casting molds comprising imaging agents in at least the facecoat of the mold, and methods for imaging inclusions in metal or metal alloy articles made using such molds.

BACKGROUND OF THE INVENTION

Investment casting is a process for forming metal or metal alloy articles (also referred to as castings) by solidifying molten metal or alloys in molds having an internal cavity in the shape of such articles. The molds are formed by serially applying layers of mold-forming materials to wax patterns formed in the shape of the desired article. The first layer applied to the pattern, referred to as the facecoat, contacts the metal or metal alloy being cast during the casting process. Materials used to form the facecoat, and perhaps other "backup" layers of the mold, can flake off the mold and become embedded in the molten metal or alloy during the casting process. As a result, the metal or alloy article includes a material or materials not intended to be part of the article, such material or materials being referred to as "inclusions".

Many industries, particularly the aerospace industry, have stringent specifications as to the acceptable content and/or size of inclusions. The location of inclusions in castings can be difficult, and in some cases prior to the present invention, impossible to detect. Some inclusions, if detected, can be removed from the metal article, and the article repaired, without compromising its structural integrity.

Titanium has been used by the investment casting industry primarily for casting articles having relatively small cross sections. However, investment casting is now being considered for producing structural components of aircrafts having significantly larger cross sections than articles cast previously. Certain inclusions in relatively thin articles can be detected using X-ray analysis. For example, thorium oxide and tungsten have been used as refractories to produce molds for investment casting. Some thorium oxide and tungsten inclusions could be detected in titanium castings by X-ray analysis because there is a sufficient difference between the density of thorium oxide and tungsten and that of titanium to allow imaging of thorium-oxide or tungsten-derived inclusions. This also generally has proved true of articles having relatively small cross sections cast using molds having yttria facecoats. The difference between the density of yttria and that of titanium is sufficient to allow detection in relatively thin parts, such as engine components. But, X-ray detection cannot be used to image yttria inclusions in titanium or titanium alloy articles as the thickness of articles produced by investment casting increases beyond some threshold thickness that is determined by various factors, primarily the thickness of the cast part, the type of metal or alloy being cast, the size of the inclusion and the material or materials used to form the mold. Inclusions also cannot be detected by X-ray if the difference between the density of the facecoat material and the metal being cast is insufficient or if the size of the inclusion is very small.

Thermal neutron radiography (N-ray) imaging agents have been used in the casting industry prior to the present invention. For example, ASTM (American Society for Testing and Materials) publication No. E 748-95 states that "[c]ontrast agents can help show materials such as ceramic residues in investment-cast turbine blades." ASTM E 748–95, p. 5, beginning at about line 46. This quote refers to the detection of ceramic residues by N-ray on articles having an internal cavity produced by initially solidifying metal about a ceramic core. The ceramic core is removed to form the cavity, and thereafter a solution of gadolinium nitrate is placed in the cavity. The gadolinium nitrate solution remains in the cavity long enough to infiltrate porous ceramic core residues that are on the surface of the article. The residues then can be imaged by N-ray. However, this method does not work for imaging inclusions.

SUMMARY

The present invention addresses the problem of imaging inclusions embedded in relatively thick castings. One feature of the method is the incorporation of an imaging agent into the investment casting mold, particularly in the facecoat of the mold, prior to casting so that inclusions can be imaged in the cast article.

One embodiment of the present method first involves providing a cast metal or metal alloy article made using a casting mold comprising an imaging agent in amounts sufficient for imaging inclusions, and thereafter determining whether the article has inclusions by N-ray analysis. The step of providing a cast metal or metal alloy article may comprise providing a casting mold comprising an N-ray imaging agent, and then casting a metal or metal alloy article using the casting mold. Typically, the mold facecoat, and perhaps one or more of the mold backup layers, comprises an imaging agent distributed substantially uniformly throughout in amounts sufficient for imaging inclusions. The article is then analyzed for inclusions by N-ray imaging. The method also can include the step of analyzing the metal or metal alloy by X-ray imaging. The method is particularly suitable for detecting inclusions in relatively thick articles, such as titanium or titanium alloy articles, where at least a portion of the article has a thickness of greater than about 2 inches. An "inclusion" can refer to materials not desired in the casting, such as inclusions derived from the mold facecoat. Alternatively, an "inclusion" can also refer to materials that should be included in the casting, such as strength-enhancing fibers, in which case the fibers can be coated with imaging agent, or intimate mixtures of fibers and imaging agents can be made and used. Detected deleterious inclusions are removed by conventional means.

Simple binary mixtures comprising an imaging agent or agents and a mold-forming material or materials can be used. The present method preferably involves forming an intimate mixture of the materials used to practice the present invention, such as intimate mixtures of refractory materials, intimate mixtures of imaging agents, and/or intimate mixtures of imaging agent or agents and a refractory or refractory materials. Intimate mixtures can be produced in a number of ways, but currently preferred methods are to either calcine or fuse the mold-forming material, such as yttria, with the imaging agent, such as gadolinia.

The difference between the linear attenuation coefficient of the article and the linear attenuation coefficient of the imaging agent should be sufficient to allow N-ray imaging of the inclusion throughout the article. The imaging agent typically includes a material, usually a metal, selected from the group consisting of boron (e.g., $TiB_2$), neodymium, samarium, europium, gadolinium, dysprosium, holmium, erbium, ytterbium, lutetium, iridium, boron, physical mixtures thereof and chemical mixtures thereof. Examples of suitable imaging agents comprising such metals include metal oxides, metal salts, intermetallics, and borides. Gadolinia is a currently preferred imaging agent for imaging inclusions in titanium or titanium alloy castings.

The refractory material used to make the facecoat slurry typically comprises from about 0.5 to about 100 weight percent imaging agent, more typically from about 1 to about 100 weight percent, even more typically from about 1 to about 65 weight percent, and preferably from about 2 to about 25 weight percent, imaging agent.

DETAILED DESCRIPTION

Figure 1A:
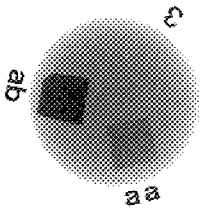
FIG. 1A is an N-ray image of an inclusion-containing test bar having three facecoat-simulating inclusions, where "aa" refers to a mixture of yttria and 2.58 weight percent gadolinia, "ab" refers to a mixture of yttria and 25.97 weight percent gadolinia, and "3" is a standard referring to 100 weight percent yttria.

The present invention concerns detecting inclusions in investment castings using N-ray analysis, or N-ray analysis in combination with X-ray analysis. The method is useful for detecting inclusions in virtually all metals or metal alloys, with particular examples being titanium metal and alloys, steel, nickel and nickel alloys, cobalt and cobalt alloys, such as cobalt-chrome alloys, metal matrix with fibers, and mixtures of these materials. An "imaging agent" is included, preferably uniformly, throughout at least the facecoat material of the mold so that any inclusions derived from mold-forming materials can be detected. It is possible that the mold-forming material of the facecoat (and perhaps the backup layers) can function as the imaging agent. But, most materials suitable as imaging agents are too expensive to make this approach commercially practical. As a result, the imaging agent generally is used in combination with a separate mold-forming material to form slurries useful for making investment-casting molds.

The following paragraphs discuss pertinent aspects of the investment casting process, methods for making molds comprising imaging agents substantially uniformly distributed throughout at least the facecoat in amounts sufficient for imaging inclusions, as well as methods for detecting inclusions in investment castings made using such molds.

I. Investment Casting Process

As stated above, a first step in the investment casting process is to provide a wax pattern (patterns made from other polymers also can be used) in the shape of the desired article. The pattern is serially immersed in aqueous or non-aqueous suspensions comprising mold-forming materials, such as refractory materials. Each layer of the mold can comprise the same mold-forming material, a different mold-forming material can be used to form each mold layer, or two or more mold-forming materials may be used to form the mold.

The facecoat is perhaps the most important mold layer because the facecoat material contacts the metal or alloy in its molten state during the casting process. As most metals are highly reactive, particularly at the elevated temperatures used during investment casting processes, it follows that the material used to produce the facecoat must be substantially non-reactive with the molten metal or alloy being cast under the conditions of the casting process.

A partial list of materials useful for forming facecoats for investment casting molds includes alumina, calcia, silica, zirconia, zircon, yttria, titania, tungsten, physical mixtures thereof, and chemical mixtures thereof (i.e., reaction products of these materials). The choice of the facecoat material depends, to a large degree, on the metal being cast. Yttria is a currently preferred facecoat material for casting articles from titanium and titanium alloys, primarily because it is less reactive with molten titanium and titanium alloys than most other mold-forming materials.

Once the facecoat is solidified about the pattern, plural additional layers, such as from about 2 to about 25 additional layers, typically from about 5 to about 20 additional layers, and more typically from about 10 to about 18 additional layers, are applied to the pattern to build up the mold. These layers are referred to herein as "backup layers". Generally speaking, inclusions are derived from the facecoat material, although it is possible that inclusions may come from backup layers as well.

"Stucco" materials also generally are applied to the wet mold layers to help form cohesive mold structures. The materials useful as stucco materials are substantially the same as those materials currently considered useful as mold-forming materials, i.e., alumina, calcia, silica, zirconia, zircon, yttria, physical mixtures thereof, and chemical mixtures thereof. A primary difference between mold-forming materials and stuccos is particle size, i.e, stuccos generally have larger particle sizes than other mold-forming materials. A range of average particle sizes currently considered suitable for use in forming investment casting slurries comprising mold-forming materials (other than stuccos) is from about 1 micron to about 30 microns, with from about 10 microns to about 20 microns being a currently preferred range of average particle size. A range of particle sizes for facecoat stucco materials generally is from about 70 grit to about 120 grit. The intermediate backup layers, i.e., from about layer 2 to about layer 5, generally include stuccos having a particle size of from about 30 grit to about 60 grit. The final backup layers generally include stuccos having a particle size of from about 12 grit to about 46 grit. Stuccos, as well as mold refractory materials, can be formed as intimate mixtures with other stucco materials and/or imaging agents for practicing the present invention.

II. Imaging Agents Useful for Imaging Inclusions

Which imaging agent to use for a particular application depends upon whether X-ray analysis or N-ray analysis, or the combination of the two, is used. Also important is the impact of the imaging agent on the quality of the casting. With respect to X-ray detection, primary considerations include (1) the difference between the density of the material being cast versus the density of the inclusion, (2) the size, thickness, shape and orientation of the inclusion, and (3) the thickness of the cross section being examined. If the difference between the density of the cast material and the inclusion is small (such as less than about 0.5 g/cc for titanium or titanium alloy castings made using yttria facecoats and having a cross-sectional thickness of less than about 1 inch), then insufficient image contrast may be provided for suitable inclusion detection by X-ray.

The difference between densities also has to increase for successful imaging as the thickness of the article increases. For example, the density of titanium is about 4.5 g/cc and that of Ti-6Al-4V is 4.43 g/cc, whereas the density of yttria is about 5 g/cc. This difference in densities is sufficient to image inclusions by X-ray analysis in only certain titanium articles, depending upon the thickness of the article and the thickness and surface area of the inclusion. Generally, X-ray analysis has proved useful for detecting inclusions in titanium or titanium alloy articles having maximum thicknesses at some portion of the article of only about 2 inches or less.

The present invention has solved the problem of detecting inclusions in relatively thick castings where X-ray analysis alone does not suffice. An N-ray imaging agent is distributed substantially uniformly throughout the facecoat, perhaps throughout one or more of the backup layers, and also perhaps in stucco material used to form the facecoat and/or one or more of the backup layers, so that inclusions containing the imaging agent can be detected. If uniform distribution of the imaging agent in the desired mold layer or stucco is not achieved, then there is the possibility that the inclusion will comprise solely mold-forming or stucco material. As a result, the facecoat-material inclusion would not be detected, and the casting might have an inclusion that sacrifices desired physical attributes.

Moreover, the present invention can be used to detect the presence of materials that are not deleterious inclusions. For example, an imaging agent or agents can be coupled with, or form an intimate mixture with, fibers of metal fiber matrix materials for imaging, amongst other things, the position and orientation of the fibers.

Simple physical mixtures of mold-forming and imaging materials generally do work to practice the present invention. But, physical mixtures are not preferred. Instead, "intimate mixtures" formed between the mold-forming material and the contrast agent are preferred. "Intimate mixture" is used herein as defined in U.S. Pat. No. 5,643,844, which patent is incorporated herein by reference. The '844 patent teaches forming intimate mixtures of certain dopant materials and mold-forming materials for the purpose of reducing the rate of hydrolysis of the mold-forming materials in aqueous investment casting slurries. "Intimate mixtures" are different from physical binary mixtures that result simply from the physical combination of two components. Typically, an intimate mixture means that the imaging agent is atomically dispersed in the mold-forming material, such as with a solid solution or as small precipitates in the crystal matrix of the solid mold-forming material. Alternatively, "intimate mixture" may refer to compounds that are fused. Fused materials may be synthesized by first forming a desired weight mixture of a source of an imaging agent, such as gadolinium oxide (gadolinia), and a source of a mold-forming material, particularly facecoat materials, such as yttrium oxide (yttria). This mixture is heated until molten and then cooled to produce the fused material. The fused material is then crushed to form particles having desired particle sizes for forming investment casting slurries as discussed above. "Intimate mixture" also may refer to a coating of the imaging agent on the external surface of the mold-forming material.

Hence, methods for the formation of intimate mixtures include, but are not limited to:

(1) melt fusion (heating the refractory material and the imaging agent to a temperature above the melting point of the mixture);

(2) solid-state sintering, referred to herein as calcination (whereby a solid material is heated to a temperature below its melting point to bring about a state of chemical homogeneity);

(3) co-precipitation of the refractory material with the contrast agent, followed by calcination; and (4) any surface coating or precipitation method by which the imaging agent can be coated or precipitated onto an outer surface region of the refractory material or vice versa.

Imaging agents currently considered particularly useful for detecting inclusions in investment castings using X-ray imaging include materials comprising metals selected from the group consisting of erbium (e.g., $Er_2O_3$) dysprosium (e.g., $Dy_2O_3$), ytterbium, lutetium, actinium, and gadolinium (e.g., $Gd_2O_3$), particularly the oxides of such compounds, i.e., erbia, dysprosia, ytterbia, lutetia, actinia, and gadolinia. Naturally occurring isotopes of these metals also could be used. One example of a naturally occurring isotope that is useful as an N-ray imaging agent is gadolinium 157, which has a thermal neutron cross section of 254,000 barns. Materials useful as imaging agents also could be salts, hydroxides, oxides, halides, sulfides, and combinations thereof. Materials that form these compounds on further treatment, such as heating, also can be used. Additional imaging agents useful for X-ray imaging can be determined by comparing the density of the metal or alloy being cast to that of potential imaging agents, particularly metal oxides, and then selecting an imaging agent having a density sufficiently greater than the density of the metal or alloy being cast to image inclusions comprising the imaging agent throughout the cross section of the casting.

Other factors also might be considered for the selection of imaging agents for X-ray imaging, such as the amount of $\alpha$ case produced. $\alpha$ case refers to a brittle, oxygen-enriched surface layer on titanium and titanium alloy castings produced by reduction of the facecoat material by the metal or alloy being cast. $\alpha$ case thickness may vary according to the temperature at which the mold/pattern was fired and/or cast. If the amount of a case is too extensive for a particular cast article, then such article may not be useable for its intended purpose. For titanium or titanium alloys, a currently preferred imaging agent for detecting inclusions by X-ray is gadolinia because it also is useful for N-ray imaging, and because the density of gadolinia is about 7.4 g/cc, whereas titanium has a density of about 4.5 g/cc.

Generally, other metals and/or alloys commonly used to produce investment castings, such as stainless steel and the nickel-based superalloys, have densities sufficiently different from that of the mold-forming materials used to cast such materials so that inclusion imaging by X-ray is not a problem. Nevertheless, the imaging agents stated above also can be used with these alloys.

N-ray imaging is discussed in ASTM E 748-95, entitled Standard Practices for Thermal Neutron Radiography of Materials, which is incorporated herein by reference. N-ray imaging is a process whereby radiation beam intensity modulation by an object is used to image certain macroscopic details of the object. N-ray uses neutrons as a penetrating radiation for imaging inclusions. The basic components required for N-ray imaging include a source of fast neutrons, a moderator, a gamma filter, a collimator, a conversion screen, a film image recorder or other imaging system, a cassette, and adequate biological shielding and interlock systems. See, ASTM E 748-95.

Whereas the selection of suitable imaging agents for X-ray detection depends upon the difference between the density of the imaging agent and that of the metal or alloy of the casting, the selection of suitable imaging agents for N-ray imaging of inclusions is determined by the linear attenuation coefficient or the thermal neutron cross section of the material being used as an imaging agent relative to that of the metal or alloy being cast. The difference between the linear attenuation coefficient or the thermal neutron cross section and that of the metal or alloy of the casting should be sufficient so that any inclusions can be imaged throughout the cross section of the article.

As with X-ray detection, N-ray detection can be practiced by simply forming physical mixtures of the imaging agent or agents and the mold-forming material or materials used to form the mold. However, as with X-ray detection a preferred method is to form intimate mixtures of the N-ray imaging agent or agents and the mold-forming material or materials selected to form the facecoat and/or the backup layers.

The materials currently deemed most useful for N-ray detection of inclusions in investment castings include those materials comprising metals selected from the group consisting of boron (e.g., $TiB_2$), neodymium, samarium, europium, gadolinium, dysprosium, holmium, erbium, ytterbium, lutetium, iridium, and mixtures thereof. Oxides of these metals currently are preferred materials for N-ray imaging, although it is possible that other materials, such as metal salts, also can be used to practice the present inclusion imaging method. Gadolinium oxide (gadolinia) is a currently preferred imaging agent for N-ray detection of inclusions in titanium or titanium alloy castings. Gadolinium has one of the highest linear attenuation coefficients of any element, i.e., about 1483.88 $cm^{-1}$, whereas the linear attenuation coefficient of titanium is about 0.68 $cm^{-1}$. The difference between the linear attenuation coefficient of titanium or titanium alloys and the linear attenuation coefficient of gadolinium makes gadolinia particularly suitable for N-ray imaging. Other imaging agents for N-ray imaging of inclusions can be selected from the group of materials having relatively large linear attenuation coefficients. For metals and/or alloys other than titanium, gadolinia also likely would be a preferred imaging agent, again primarily because of the relatively large linear attenuation coefficient of gadolinium.

Table 1 provides data concerning those materials currently considered particularly useful for N-ray and X-ray imaging of inclusions in investment castings. Data for titanium also is provided for purposes of comparison.

TABLE 1

Densities and Thermal Neutron Linear Attenuation Coefficients Using Average Scattering and Thermal Absorption Cross Sections for the Naturally Occurring Elements[A]

| Element | | Cross Section (barns)[a] | | Density of Metal Oxides | Linear Attenuation | Technique |
|---|---|---|---|---|---|---|
| Atomic No. | Symbol | Scattering | Absorption | (g/cc) | Coefficient ($cm^{-1}$)[c] | Used |
| 3 | Li | 0.95 | 70.6 | 2.01 | 3.31 | N-ray |
| 5 | B | 4.27 | 767 | 2.46 | 101.79 | N-ray |
| 22 | Ti | 4.09 | 6.09 | 4.5 | 0.58 | Reference |
| 41 | Nb | 6.37 | 1.15 | 7.03 | 0.42 | X-ray |
| 60 | Nd | 16 | 60.6 | 7.24 | 1.89 | X-ray |
| 62 | Sm | 38 | 5670 | 8.3 | 171.86 | Both |
| 63 | Eu | . . . | 4565 | 7.42 | 94.82 | Both |
| 64 | Gd | 172 | 48890 | 7.4 | 1483.88 | Both |
| 66 | Dy | 105.9 | 940 | 7.81 | 33.13 | Both |
| 67 | Ho | 8.65 | 64.7 | — | 2.35 | Both |
| 68 | Er | 9 | 159.2 | 8.64 | 5.49 | Both |
| 70 | Yb | 23.4 | 35.5 | 9.2 | 1.43 | X-ray |
| 71 | Lu | 6.8 | 76.4 | 9.4 | 2.82 | Both |
| 77 | Ir | 14.2 | 425.3 | 11.7 | 30.86 | Both |

[A]ASTM E 748-95 with updated data primarily from Neutron Cross Sections: Neutron Resonance Parameters and Thermal Cross Sections, S. F. Mughabghab Academic Press, Inc., San Diego, Ca, 1981.
[a]All cross-section values are most probable values.
[c]Linear attenuation coefficients were calculated using nominal elemental atomic weights and densities.

III. Forming Molds Comprising Imaging Agents

The formation of slurries for making investment casting molds by serial application of mold-forming and stucco materials to patterns is known to those of ordinary skill in the art. The present method differs from these methods by forming mold layers that comprise an imaging agent or agents. Thus, simple physical mixtures or intimate mixtures of the imaging agent and the mold-forming material are used to form slurry suspensions, typically an aqueous suspension, but perhaps also an organic-liquid based suspension. The pattern is serially dipped into an investment casting slurry or slurries comprising mold-forming material or materials and an imaging agent or agents.

The following examples are intended to illustrate certain features of the present invention, including how to make investment casting slurries and molds therefrom for practicing the present invention. The invention should not be limited to the particular features exemplified.

EXAMPLE 1

This example describes the preparation of a slurry useful for forming mold facecoats for investment castings, as well as how to make molds comprising such facecoats. Amounts stated in this and the following examples are percents based upon the total weight of the slurry (weight percents), unless noted otherwise. All steps were done with continuous mixing unless stated otherwise.

In this particular example, the facecoat refractory material and the imaging agent were the same material, i.e., dysprosia. Dysprosia is a good candidate for imaging inclusions by X-ray because it has a density of about 8.2 g/cc.

A mixture was first formed by combining 2.25 weight percent deionized water with 0.68 weight percent tetraethyl ammonium hydroxide. 1.37 weight percent latex (Dow 460 NA), 0.15 weight percent surfactant (NOPCOWET C-50) and 5.50 weight percent of a colloidal silica, such as LUDOX® SM (LUDOX® SM comprises aqueous colloidal silica, wherein the silica particles have an average particle diameter of about 7 nms) were then added to the mixture with continuous stirring. 90.05 weight percent dysprosia refractory/imaging agent was added to the aqueous composition to form a facecoat slurry. In this Example 1, and with Examples 2–3, a trace amount of Dow 1410 antifoam was added to the slurries after their formation. Moreover, and unless stated otherwise, the mixtures were made by combining the materials in the order stated in tables provided with respect to certain examples.

Wax patterns in the shape of a test bar were first immersed in the facecoat slurry composition to form a facecoat comprising dysprosia. Seventy grit fused alumina was used as the stucco material for the facecoat. Two alumina slurry layers with an ethyl silicate binder were applied over the facecoat to form the intermediate layers. The stucco material for the second and third intermediate layers was 46 grit fused alumina. Mold layers 4–10 were then serially applied using a zircon flour having a colloidal silica binder. The stucco material used for mold layers 4–10 was 46 grit fused alumina. After building ten layers, the pattern was removed in an autoclave to create a mold suitable for receiving molten titanium alloy to cast test bars.

Molten Ti 6-4 alloy was poured into the test bar mold and allowed to solidify. The mold was then removed from about the casting to produce a test bar having a diameter of about 1 inch. The test bar was then tested for the presence of $\alpha$ case, as discussed in more detail below.

The test bar also was subjected to X-ray imaging to determine the presence of inclusions. Because inclusions do not occur every time a casting is made, and because the location of an inclusion is difficult to predict (although software is now being developed for such predictions), a system was developed to mimic the presence of inclusions in samples made according to the present examples. A small amount of facecoat flake (i.e., a facecoat material comprising dysprosia for this example), was placed on top of a 1-inch-thick test bar. A second 1-inch test bar was placed over the facecoat flake. These two test bars were then welded together to form a 2-inch thick inclusion-containing test bar. The test bars were hot isostatically pressed (HIP) at 1650° F. and 15,000 psi to produce test bars having no detectable interface by nondestructive detection methods.

An X-ray was taken of an inclusion-containing test bar made in this fashion using the flake made from the facecoat slurry. The dysprosia inclusion was clearly seen (but photographic images from the X-ray are difficult to make). The fact that the dysprosia inclusions was seen clearly demonstrates that dysprosia is a good imaging agent for imaging inclusions in titanium and titanium-alloy castings using X-ray imaging techniques.

EXAMPLE 2

This example concerns the production of a facecoat slurry, molds made having such facecoat, and titanium test bars cast using such molds to determine the effectiveness of inclusion imaging using the imaging agent in the facecoat. In contrast to Example 1, this example used a physical mixture of a refractory material, i.e., yttria, with an imaging agent, i.e., dysprosia, to form the facecoat. Otherwise, the facecoat slurry and mold were produced in a manner substantially identical to that of Example 1. The materials used to produce the facecoat slurry are provided below in Table 2.

TABLE 2

| MATERIALS | WEIGHT PERCENT |
|---|---|
| deionized water | 2.64 |
| tetraethyl ammonium hydroxide | 0.79 |
| titanium dioxide | 3.22 |
| latex (Dow 460 NA) | 1.63 |
| surfactant (NOPCOWET C-50) | 0.18 |
| colloidal silica (Ludox SM) | 6.48 |
| yttria | 32.17 |
| dysprosia | 52.89 |

As in Example 1, a test bar was produced from Ti 6-4 alloy using molds with facecoats having the composition stated in Table 2. This test bar was also tested for α case and the α-case data is provided by Table 5.

An inclusion-containing test bar was made using a flake comprising a physical mixture of yttria and dysprosia. The test bar made in this manner was then subjected to X-ray imaging to determine whether the inclusion could be detected. The X-ray image clearly showed the presence of the facecoat-simulated inclusion in the center of the inclusion-containing test bar.

EXAMPLE 3

This example concerns the production of a facecoat slurry, molds made having such facecoat, and Ti 6-4 test bars cast using these molds to determine the amount of α case produced in such test bars. As with Example 1, the refractory material and the imaging agent were the same material, i.e., erbia. Otherwise, the facecoat slurry and mold were produced in a manner substantially identical to that of Example 1. The materials used to produce the facecoat slurry are provided below in Table 3.

TABLE 3

| MATERIALS | WEIGHT PERCENT |
|---|---|
| deionized water | 2.13 |
| tetraethyl ammonium hydroxide | 0.64 |
| latex (Dow 460 NA) | 1.30 |
| surfactant (NOPCOWET C-50) | 0.14 |
| colloidal silica (Ludox SM) | 5.21 |
| erbia | 90.58 |

As in Example 1, Ti 6-4 test bars having a diameter of about 1 inch were cast using molds having a facecoat produced using the composition provided in Table 3. The amount of α case detected in test bars made according to this Example 3 is provided below in Table 5.

An inclusion-containing test bar was made using a flake comprising erbia as the refractory and the imaging agent. The test bar made in this manner was then subjected to X-ray imaging to determine whether the inclusion could be detected. The X-ray image clearly showed the presence of the facecoat-simulated inclusion in the center of the inclusion-containing test bar.

EXAMPLE 4

This example concerns the production of a facecoat slurry, molds made having such facecoat, and Ti 6-4 test bars cast using such molds to determine the effectiveness of inclusion imaging using the facecoat material. As with Example 2, the facecoat slurry comprised a physical mixture of a mold-forming material, i.e., yttria, and an imaging agent, i.e, erbia. Otherwise, the facecoat slurry and mold were produced in a manner substantially identical to that of Example 1. The materials used to produce the facecoat slurry are provided below in Table 4.

TABLE 4

| MATERIALS | WEIGHT PERCENT |
|---|---|
| deionized water | 2.25 |
| tetraethyl ammonium hydroxide | 0.83 |
| titanium dioxide | 3.27 |
| latex (Dow 460 NA) | 1.65 |
| surfactant (NOPCOWET C-50) | 0.19 |
| colloidal silica (Ludox SM) | 6.57 |
| yttria | 32.67 |
| erbia | 52.57 |

An inclusion-containing test bar was made using a flake comprising a physical mixture of yttria and erbia. The test bar made in this manner was then subjected to X-ray imaging to determine whether the inclusion could be detected. The X-ray image clearly showed the presence of the facecoat-simulated inclusion in the center of the inclusion-containing test bar.

The amount of α case in test bars produced as stated above in Examples 1–4 is provided below in Table 5.

Because yttria has been found to minimize α case in titanium and titanium alloy castings, it is used as a control for comparing the α case results of the other materials considered useful as imaging agents.

TABLE 5

| Example No. | α case, inches | Left | Top | Right |
|---|---|---|---|---|
| 1. | a. Continuous | a. 0.007 | a. 0.007 | a. 0.003 |
| | b. Total | b. 0.016 | b. 0.017 | b. 0.012 |
| 2. | a. Continuous | a. 0.003 | a. 0.003 | a. 0.003 |
| | b. Total | b. 0.010 | b. 0.012 | b. 0.012 |
| 3. | a. Continuous | a. 0.009 | a. 0.008 | a. 0.002 |
| | b. Total | b. 0.014 | b. 0.019 | b. 0.004 |
| 4. | a. Continuous | a. 0.002 | a. 0.002 | a. 0.003 |
| | b. Total | b. 0.009 | b. 0.004 | b. 0.019 |
| 5. Yttria facecoat as a control. | a. Continuous | a. 0.002 | a. 0.002 | a. 0.002 |
| | b. Total | b. 0.004 | b. 0.005 | b. 0.003 |

Table 5 shows that castings made according to the present invention may have slightly more α case than occurs by simply using yttria as a refractory material, as would be expected. Castings having a continuous α case of about 0.020 inch or less, preferably about 0.015 inch or less, and a total α case of about 0.035 inch or less, and preferably about 0.025 inch or less, are still considered useful castings. As a result, Table 5 shows that articles made according to the present invention are acceptable even though such castings may have slightly more α case than castings made using molds having yttria facecoats comprising no imaging agent.

However, if normal casting procedures result in too much α case using molds made in accordance with the present invention, then other procedures may be used in combination with the process of the present invention to decrease the α case. For example, the mold might be cooled from the normal casting temperature of about 1,800° F. to a lower temperature, such as a temperature of about 700° F. See the α-case results provided below for Examples 11–17, and 19–20. Alternatively, delay pour techniques might be used. Delay-pour casting is discussed in U.S. application Ser. No. 08/829,534, filed on Mar. 28, 1997, entitled Method for Reducing Contamination of Investment Castings by Aluminum, Yttrium or Zirconium, now abandoned, which is incorporated herein by reference.

EXAMPLE 5

This example concerns the production of a facecoat slurry, molds made having such facecoat, and Ti 6-4 step-wedge test bars cast using such molds to determine the effectiveness of inclusion imaging using the facecoat material, as well as the amount of α case produced by casting such test bars. As with Example 2, this example used a physical mixture of a refractory material, i.e., yttria, and an imaging agent, i.e, gadolinia, for the production of the facecoat slurry. Otherwise, the facecoat slurry and mold were produced in a manner substantially identical to that of Example 1. The materials used to produce the facecoat slurry are provided below in Table 6.

TABLE 6

| MATERIALS | WEIGHT PERCENT |
|---|---|
| deionized water | 4.10 |
| tetraethyl ammonium hydroxide | 1.00 |
| titanium dioxide | 4.00 |
| latex (Dow 460 NA) | 1.96 |
| surfactant (NOPCOWET C-50) | 0.21 |
| Ludox SM (colloidal silica) | 7.80 |
| yttria | 78.58 |
| gadolinia | 2.25 |
| antifoaming agent (Dow 1410) | 0.0 |

Step-wedge test castings (1.5 inches; 1 inch; 0.5 inch; 0.25 inch and 0.125 inch) were cast from Ti 6-4 alloy metal using molds having a facecoat produced using the composition provided in Table 6. α-case test results for these step-wedge castings are provided below in Table 7. C indicates continuous alpha case while T indicates total alpha case.

TABLE 7

| Face-coat | 1.5" | | 1.0" | | 0.5" | | 0.25" | | 0.125" | |
|---|---|---|---|---|---|---|---|---|---|---|
| refractory flour is 100% yttria | C | T | C | T | C | T | C | T | C | T |
| | 0.004 | 0.009 | 0.003 | 0.006 | 0.003 | 0.006 | 0.002 | 0.007 | 0.001 | 0.003 |
| refractory flour is yttria plus 2.25 wt. % gadolinia | C | T | C | T | C | T | C | T | C | T |
| | 0.003 | 0.007 | 0.009 | 0.019 | 0.004 | 0.009 | 0.002 | 0.004 | 0.001 | 0.003 |

FIG. 1 A is an N-ray image of a 2-inch-thick inclusion-containing test bar made having three facecoat-simulating inclusions sandwiched between two 1-inch thick plates, including one inclusion made from yttria and acting as a control where no inclusion is seen (the inclusion labeled "3" in FIG. 1A), and one inclusion labeled "aa" comprising a physical mixture of yttria and 2.25 weight percent (slurry basis)/2.58 weight percent (dry basis) gadolinia. The inclusion comprising the yttria-gadolima imaging composition is clearly seen in FIG. 1A. Hence, FIG. 1A demonstrates that inclusions can be detected using N-ray imaging of castings made from molds comprising imaging agents physically mixed with other refractory materials according to the method of the present invention.

EXAMPLE 6

This example concerns the production of a facecoat slurry, molds made having such facecoat, and Ti 6-4 test bars cast using such molds to determine the effectiveness of inclusion imaging using the facecoat material, as well as the amount of α case produced by casting such test bars. As with Example 2, this example used a physical mixture of a refractory material, i.e., yttria, and an imaging agent, i.e, gadolinia, for the production of the facecoat slurry. Otherwise, the facecoat slurry and mold were produced in a manner substantially identical to that of Example 1. The materials used to produce the facecoat slurry are provided below in Table 8.

TABLE 8

| MATERIALS | WEIGHT PERCENT |
|---|---|
| deionized water | 3.84 |
| tetraethyl ammonium hydroxide | 0.94 |
| titanium dioxide | 3.75 |
| latex (Dow 460 NA) | 1.84 |
| surfactant (NOPCOWET C-50) | 0.20 |
| colloidal sllica (Ludox SM) | 7.33 |
| yttria | 60.71 |
| gadolinia | 21.30 |
| antifoaming agent (Dow 1410) | 0.09 |

FIG. 1A is the N-ray image discussed above in Example 5 where the sample marked "ab" is an inclusion comprising a physical mixture of yttria and 21.30 weight percent (slurry basis)/25.97 weight percent (dry basis) gadolinia that was made using the facecoat slurry composition stated in Table 8. The inclusion made having 25.97 weight percent gadolinia is the inclusion most clearly seen in FIG. 1A. Hence, FIG. 1A not only demonstrates that facecoat inclusions in the interior of the titanium-alloy casting are readily detected using N-ray imaging and gadolinia imaging agents according to the method of the present invention, but further that the clarity of the N-ray image can be adjusted by the amount of the imaging agent used. This suggests that inclusions may be detected in castings having cross sections of greater than two inches by increasing the amount of imaging agent used. One possible method for determining the maximum amount of a particular imaging agent that can be used for forming a casting is to determine the amount of imaging agent that can be used to generally obtain a casting having a continuous $\alpha$ case of about 0.020 inch or less and a total $\alpha$ case of about 0.035 inch or less.

EXAMPLE 7

This example concerns the production of a facecoat slurry, molds made having such facecoat, and Ti 6-4 test bars cast using such molds to determine the effectiveness of inclusion imaging using the facecoat material, as well as the amount of $\alpha$ case produced by casting such test bars. As with Example 2, this example used a physical mixture of a refractory material, i.e., yttria, and an imaging agent, i.e, samaria, for the production of the facecoat slurry. Otherwise, the facecoat slurry and mold were produced in a manner substantially identical to that of Example 1. The materials used to produce the facecoat slurry are provided below in Table 9.

TABLE 9

| MATERIALS | WEIGHT PERCENT |
|---|---|
| deionized water | 4.04 |
| tetraethyl ammonium hydroxide | 0.97 |
| titanium dioxide | 3.85 |
| latex (Dow 460 NA) | 1.93 |

TABLE 9-continued

| MATERIALS | WEIGHT PERCENT |
|---|---|
| surfactant (NOPCOWET C-50) | 0.21 |
| colloidal silica (Ludox SM) | 7.71 |
| yttria | 69.74 |
| samaria | 11.45 |
| antifoaming agent (Dow 1410) | 0.1 |

Figure 1B:
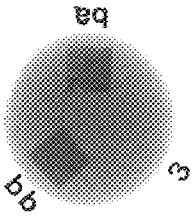
FIG. 1B is an N-ray image of an inclusion-containing test bar having three facecoat-simulating inclusions, where "ba" refers to a mixture of yttria and 13.11 weight percent samaria, "bb" refers to a mixture of yttria and 5.14 weight percent gadolinia, and "3" is a standard referring to 100 weight percent yttria.

FIG. 1B is an N-ray image of an inclusion-containing test bar having three facecoat-simulating inclusions. The inclusion in FIG. 1B marked "ba"comprised a physical mixture of yttria and 11.45 weight percent (slurry basis)/13.11 weight percent (dry basis) samaria that was made using the slurry composition of Table 9, and the inclusion marked "3" being yttria as a control. The inclusion made having 13.11 weight percent samaria clearly can be seen in FIG. 1B, indicating that samaria can be used as an imaging agent for N-ray imaging of inclusions according to the method of the present invention.

EXAMPLE 8

This example concerns the production of a facecoat slurry, molds made having such facecoat, and Ti 6-4 test bars cast using such molds to determine the effectiveness of inclusion imaging using the facecoat material, as well as the amount of $\alpha$ case produced by casting such test bars. As with Example 2, this example used a physical mixture of a refractory material, i.e., yttria, and an imaging agent, i.e, gadolinia, for the production of the facecoat slurry. Otherwise, the facecoat slurry and mold were produced in a manner substantially identical to that of Example 1. The materials used to produce the facecoat slurry are provided below in Table 10.

TABLE 10

| MATERIALS | WEIGHT PERCENT |
|---|---|
| deionized water | 4.06 |
| tetraethyl ammonium hydroxide | 0.99 |
| titanium dioxide | 3.97 |
| latex (Dow 460 NA) | 1.94 |
| surfactant (NOPCOWET C-50) | 0.21 |
| colloidal silica (Ludox SM) | 7.76 |
| yttria | 76.48 |
| gadolinia | 4.49 |
| antifoaming agent (Dow 1410) | 0.10 |

FIG. 1B is the N-ray image discussed in Example 7 where the inclusion marked "bb" comprises a physical mixture of yttria and 4.49 weight percent (slurry basis)/5.14 weight percent (dry basis) gadolinia made using the facecoat slurry composition stated in Table 10. Inclusion "bb", made having 5.14 weight percent gadolinia, is clearly seen in FIG. 1B, and is as distinguishable as inclusion "ba" in FIG. 1B made from the slurry having 11.95 weight percent samaria.

EXAMPLE 9

This example concerns the production of a facecoat slurry, molds made having such facecoat, and Ti 6-4 test bars cast using such molds to determine the effectiveness of inclusion imaging using the facecoat material, as well as the amount of α case produced by casting such test bars. As with Example 2, this example used a physical mixture of a refractory material, i.e., yttria, and an imaging agent, i.e, samaria, for the production of the facecoat slurry. Otherwise, the facecoat slurry and mold were produced in a manner substantially identical to that of Example 1. The materials used to produce the facecoat slurry are provided below in Table 11.

TABLE 11

| MATERIALS | WEIGHT PERCENT |
|---|---|
| deionized water | 3.52 |
| tetraethyl ammonum hydroxide | 0.85 |
| titanium dioxide | 3.36 |
| latex (Dow 460 NA) | 1.68 |
| surfactant (NOPCOWET C-50) | 0.18 |
| colloidal silica (Ludox SM) | 6.71 |
| yttria | 33.75 |
| samaria | 49.86 |
| antifoaming agent (Dow 1410) | 0.09 |

Figure 1C:
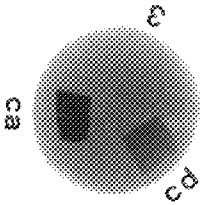
FIG. 1C is an N-ray image of an inclusion-containing test bar having three facecoat-simulating inclusions, where "ca" refers to a mixture of yttria and 56.03 weight percent samaria, "cd" refers to a mixture of yttria and 30.8 weight percent samaria, and "3" is a standard referring to 100 weight percent yttria.

FIG. 1C is an N-ray image of an inclusion-containing test bar having three facecoat-simulating inclusions. The inclusion in FIG. 1C marked "ca" comprised a physical mixture of yttria and 49.86 weight percent (slurry basis)/56.03 weight percent (dry basis) samaria that was made using the slurry composition of Table 11. The inclusion in FIG. 1C marked "3" is yttria, which was used as a control. The inclusion made having 56.03 weight percent samaria can be clearly seen as "ca" in FIG. 1C.

EXAMPLE 10

This example concerns the production of a facecoat slurry, molds made having such facecoat, and Ti 6-4 test bars cast using such molds to determine the effectiveness of inclusion imaging using the facecoat material, as well as the amount of α case produced by casting such test bars. As with Example 2, this example used a physical mixture of a refractory material, i.e., yttria, and an imaging agent, i.e, samaria, for the production of the facecoat slurry. Otherwise, the facecoat slurry and mold were produced in a manner substantially identical to that of Example 1. The materials used to produce the facecoat slurry are provided below in Table 12.

TABLE 12

| MATERIALS | WEIGHT PERCENT |
|---|---|
| deionized water | 3.83 |
| tetraethyl ammonium hydroxide | 0.92 |
| titanium dioxide | 3.65 |
| latex (Dow 460 NA) | 1.82 |
| surfactant (NOPCOWET C-50) | 0.20 |
| colloidal silica (Ludox SM) | 7.30 |
| yttria | 55.07 |
| samaria | 27.11 |
| antifoaming agent (Dow 1410) | 0.10 |

FIG. 1C is the N-ray image discussed in Example 9 where the inclusion marked "cd" comprises a physical mixture of yttria and 27.11 weight percent (slurry basis)/30.80 weight percent (dry basis) samaria made using the facecoat slurry composition stated in Table 12. The inclusion of labeled "cd", made having 30.8 weight percent samaria, is clearly seen in FIG. 1C.

EXAMPLE 11

This example concerns the production of facecoat slurries comprising an intimate mixture of a mold-forming material and an imaging agent, molds made having such facecoat, and Ti 6-4 test bars cast using such molds to determine the effectiveness of inclusion imaging using the facecoat material, as well as the amount of α case produced by casting such test bars at two different temperatures, namely 700° F. and 1800° F. This Example 11 concerns a facecoat slurry comprising an intimate mixture of calcined erbia/yttria. Otherwise, the facecoat slurry and mold were produced in a manner substantially identical to that of Example 1. The materials used to produce the facecoat slurry are provided below in Table 13.

TABLE 13

| MATERIALS | WEIGHT PERCENT |
|---|---|
| deionized water | 3.67 |
| tetraethyl ammonium hydroxide | 0.87 |
| titanium dioxide | 3.50 |
| latex (Dow 460 NA) | 1.75 |
| surfactant (NOPCOWET C-50) | 0.17 |
| colloidal silica (Ludox SM) | 6.99 |
| calcined erbia/yttria (36%/64%) | 82.96 |
| antifoaming agent (Dow 1410) | 0.09 |

α-case data is provided below in Table 14 for test bars cast at 1,800° F. and 700° F. using shells having the composition discussed in Example 11.

TABLE 14

| Face-coat | 1.5" | | 1.0" | | 0.5" | | 0.25" | | 0.125" | |
|---|---|---|---|---|---|---|---|---|---|---|
| | Example 11 - 1800° F. | | | | | | | | | |
| refractory flour was | C | T | C | T | C | T | C | T | C | T |
| 100% yttria | 0.005 | 0.009 | 0.009 | 0.028 | 0.003 | 0.010 | 0.002 | 0.004 | 0.001 | 0.003 |

TABLE 14-continued

| Face-coat | 1.5" | | 1.0" | | 0.5" | | 0.25" | | 0.125" | |
|---|---|---|---|---|---|---|---|---|---|---|
| refractory flour was yttria plus 36 wt. % erbia | C 0.003 | T 0.006 | C 0.006 | T 0.016 | C 0.003 | T 0.014 | C 0.002 | T 0.009 | C 0.001 | T 0.004 |
| Example 11 - 700° F. | | | | | | | | | | |
| refractory flour was 100% yttria | C 0.002 | T 0.006 | C 0.002 | T 0.004 | C 0.002 | T 0.007 | C 0.002 | T 0.005 | C 0.001 | T 0.003 |
| refractory flour was yttria plus 36 wt. % erbia | C 0.003 | T 0.010 | C 0.003 | T 0.013 | C 0.003 | T 0.010 | C 0.001 | T 0.005 | C 0.001 | T 0.003 |

The α-case data provided by Table 14 shows that parts cast using shells made as described in Example 11 had acceptable α case, i.e., less than about 0.020 inch continuous α case, and less than about 0.035 inch total α case. The α-case data also shows, as would be expected, that reducing the mold temperature also reduces the amount of α case. This is best illustrated by comparing the total α case at the two different temperatures for castings of a particular thickness. For example, the 1 inch test bar had a total α case of about 0.016 inch at 1,800° F., and 0.013 inch at 700° F.

EXAMPLE 12

This example concerns the production of facecoat slurries comprising an intimate mixture of a mold-forming material and an imaging agent, molds made having such facecoat, and Ti 6-4 test bars cast using such molds to determine the effectiveness of inclusion imaging using the facecoat material, as well as the amount of α case produced by casting such test bars. This Example 12 concerns a facecoat slurry comprising calcined erbia/yttria. Otherwise, the facecoat slurry and mold were produced in a manner substantially identical to that of Example 1. The materials used to produce the facecoat slurry are provided below in Table 15.

TABLE 15

| MATERIALS | WEIGHT PERCENT |
|---|---|
| deionized water | 3.26 |
| tetraethyl ammonium hydroxide | 0.78 |
| titanium dioxide | 3.10 |
| latex (Dow 460 NA) | 1.55 |
| surfactant (NOPCOWET C-50) | 0.16 |

TABLE 15-continued

| MATERIALS | WEIGHT PERCENT |
|---|---|
| colloidal silica (Ludox SM) | 6.20 |
| calcined erbia/yttria (63%/37%) | 84.88 |
| antifoaming agent (Dow 1410) | 0.07 |

α-case data at 1,800° F. and 700° F. for test bars made using shells having the composition discussed in Example 11 is provided below in Table 16.

TABLE 16

| Face-coat | 1.5" | | 1.0" | | 0.5" | | 0.25" | | 0.125" | |
|---|---|---|---|---|---|---|---|---|---|---|
| Example 12 - 1800° F. | | | | | | | | | | |
| refractory flour was 100% yttria | C 0.004 | T 0.009 | C 0.004 | T 0.005 | C 0.002 | T 0.009 | C 0.004 | T 0.010 | C 0.003 | T 0.009 |
| refractory flour waa yttria plus 62 wt. % erbia | C 0.004 | T 0.007 | C 0.004 | T 0.009 | C 0.003 | T 0.009 | C 0.004 | T 0.012 | C 0.001 | T 0.003 |
| Example 12 - 700° F. | | | | | | | | | | |
| refractory flour was 100% yttria | C 0.001 | T 0.004 | C 0.005 | T 0.010 | C 0.003 | T 0.005 | C 0.00 | T 0.00 | C 0.00 | T 0.00 |
| Refractory flour was yttria plus 62 wt. % erbia | C 0.001 | T 0.003 | C 0.002 | T 0.008 | C 0.002 | T 0.002 | C 0.00 | T 0.00 | C 0.003 | T 0.010 |

Information provided by Table 16 shows that parts cast using shells made as described in Example 12 had acceptable α case, and that reducing the mold temperature also generally reduces the amount of α case.

EXAMPLE 13

This example concerns the production of facecoat slurries comprising an intimate mixture of a mold-forming material and an imaging agent, molds made having that facecoat, and Ti 6-4 test bars cast using such molds to determine the effectiveness of inclusion imaging using the facecoat material, as well as the amount of α case produced by casting such test bars. This Example 13 concerns a facecoat slurry comprising calcined dysprosia/yttria. Otherwise, the facecoat slurry and mold were produced in a manner substantially identical to that of Example 1. The materials used to produce the facecoat slurry are provided below in Table 17.

TABLE 17

| MATERIALS | WEIGHT PERCENT |
|---|---|
| deionized water | 3.60 |
| tetraethyl ammonium hydroxide | 0.86 |
| titanium dioxide | 3.43 |
| latex (Dow 460 NA) | 1.71 |
| surfactant (NOPCOWET C-50) | 0.17 |
| colloidal silica (Ludox SM) | 6.86 |
| calcined dysprosia/yttria (45%/55%) | 83.28 |
| antifoaming agent (Dow 1410) | 0.09 |

Figure 1D:
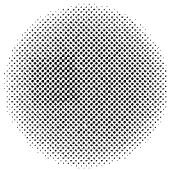
FIG. 1D is an N-ray image of an inclusion-containing test bar having a facecoat-simulating inclusion comprising cocalcined yttria and 45 weight percent dysprosia.

FIG. 1D is an N-ray image of a test bar made from a mold having the facecoat composition described above. FIG. 1D shows the presence of the inclusion.

α-case data at 1,800° F. and 700° F. for parts made using shells having the composition discussed in Example 13 is provided below in Table 18.

TABLE 18

| Face-coat | 1.5" | | 1.0" | | 0.5" | | 0.25" | | 0.125" | |
|---|---|---|---|---|---|---|---|---|---|---|
| Example 13 - 1800° F. | | | | | | | | | | |
| refractory flour was 100% yttria | C 0.006 | T 0.009 | C 0.003 | T 0.007 | C 0.001 | T 0.004 | C 0.001 | T 0.003 | C <0.001 | T 0.002 |
| refraetory flour was yttria plus 45 wt. % dysprosia | C 0.004 | T 0.006 | C 0.012 | T 0.032 | C 0.003 | T 0.014 | C 0.003 | T 0.010 | C <0.001 | T 0.002 |
| Example 13 - 700° F. | | | | | | | | | | |
| refractory flour was 100% yttria | C 0.003 | T 0.004 | C 0.003 | T 0.014 | C 0.001 | T 0.004 | C <0.001 | T 0.002 | C <0.001 | T <0.001 |
| refractory flour was yttria plus 45 wt. % dysprosia | C 0.003 | T 0.005 | C 0.002 | T 0.004 | C 0.003 | T 0.010 | C 0.001 | T 0.004 | C <0.001 | T 0.004 |

EXAMPLE 14

This example concerns the production of facecoat slurries comprising an intimate mixture of a mold-forming material and an imaging agent, molds made using such facecoat, and Ti 6-4 test bars cast using such molds to determine the effectiveness of inclusion imaging using the facecoat material, as well as the amount of α case produced by casting such test bars. This Example 14 concerns a facecoat slurry comprising calcined dysprosia/yttria. Otherwise, the facecoat slurry and mold were produced in a manner substantially identical to that of Example 1. The materials used to produce the facecoat slurry are provided below in Table 19.

TABLE 19

| MATERIALS | WEIGHT PERCENT |
|---|---|
| deionized water | 3.35 |
| tetraethyl ammonium hydroxide | 0.80 |
| titanium dioxide | 3.19 |
| latex (Dow 460 NA) | 1.59 |
| surfactant (NOPCOWET C-50) | 0.16 |
| colloidal silica (Ludox SM) | 6.38 |
| calcined dysprosia/yttria (62%/38%) | 84.46 |
| antifoaming agent (Dow 1410) | 0.07 |

Figure 1E:
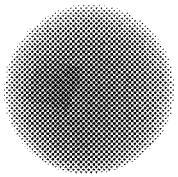
FIG. 1E is an N-ray image of an inclusion-containing test bar having a facecoat-simulating inclusion comprising cocalcined yttria and 62 weight percent dysprosia.

FIG. 1E is an N-ray image of a test bar made from a mold having the facecoat composition described above. FIG. 1E shows the presence of the inclusion.

α-case data for test bars cast using shell temperatures of 1,800° F. and 700° F. and using shells having the composition discussed in Example 14 is provided below in Table 20.

TABLE 20

| Face-coat | 1.5" | | 1.0" | | 0.5" | | 0.25" | | 0.125" | |
|---|---|---|---|---|---|---|---|---|---|---|
| Example 14 - 1800° F. | | | | | | | | | | |
| refractory flour was 100% yttria | C 0.004 | T 0.007 | C 0.006 | T 0.020 | C 0.001 | T 0.005 | C 0.002 | T 0.009 | C <0.001 | T 0.003 |
| refractory flour was yttria plus 62 wt. % dysprosia | C 0.004 | T 0.007 | C 0.008 | T 0.027 | C 0.002 | T 0.007 | C 0.002 | T 0.010 | C 0.001 | T 0.004 |
| Example 14 - 700° F. | | | | | | | | | | |
| refractory flour was 100% yttria | C 0.002 | T 0.004 | C 0.002 | T 0.004 | C 0.001 | T 0.004 | C 0.001 | T 0.003 | C <0.001 | T <0.001 |
| refractory flour was yttria plus 62 wt. % dysprosia | C 0.003 | T 0.005 | C 0.003 | T 0.011 | C 0.002 | T 0.005 | C <0.001 | T 0.004 | C <0.001 | T <0.001 |

EXAMPLE 15

This example concerns the production of facecoat slurries comprising an intimate mixture of a mold-forming material and an imaging agent, molds made having such facecoat, and Ti 6-4 test bars cast using such molds to determine the effectiveness of inclusion imaging using the facecoat material, as well as the amount of α case produced by casting such test bars. This Example 15 concerns a facecoat slurry comprising calcined gadolinia/yttria. Otherwise, the facecoat slurry and mold were produced in a manner substantially identical to that of Example 1. The materials used to produce the facecoat slurry are provided below in Table 21.

TABLE 21

| MATERIALS | WEIGHT PERCENT |
|---|---|
| deionized water | 4.19 |
| tetraethyl ammonium hydroxide | 1.00 |
| titanium dioxide | 3.99 |
| latex (Dow 460 NA) | 1.99 |
| surfactant (NOPCOWET C-50) | 0.20 |
| colloidal silica (Ludox SM) | 7.97 |
| calcined gadolinia/yttria (01%/99%) | 80.56 |
| antifoaming agent (Dow 1410) | 0.10 |

Figure 1F:
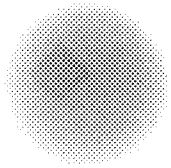
FIG. 1F is an N-ray image of an inclusion-containing test bar having a facecoat-simulating inclusion comprising cocalcined yttria and 1 weight percent dysprosia.

FIG. 1F is an N-ray image of a test bar made from a mold having the facecoat composition described above. FIG. 1F shows the presence of the inclusion.

α-case data for test bars cast using shells having the composition discussed in Example 15 is provided below in Table 22.

TABLE 22

| Face-coat | 1.5" | | 1.0" | | 0.5" | | 0.25" | | 0.125" | |
|---|---|---|---|---|---|---|---|---|---|---|
| Example 15 - 1800° F. | | | | | | | | | | |
| refractory flour was 100% yttria | C 0.005 | T 0.009 | C 0.003 | T 0.006 | C 0.009 | T 0.028 | C 0.002 | T 0.003 | C 0.00 | T 0.00 |
| refractory flour was yttria plus 1 wt. % gadolinia | C 0.007 | T 0.012 | C 0.002 | T 0.005 | C 0.003 | T 0.007 | C 0.002 | T 0.003 | C 0.00 | T 0.00 |
| Example 15 - 700° F. | | | | | | | | | | |
| refractory flour was 100% yttria | C 0.002 | T 0.005 | C 0.001 | T 0.003 | C 0.00 | T 0.00 | C 0.00 | T 0.00 | C 0.00 | T 0.00 |
| refractory flour was yttria plua 1 wt. % gadolinia | C 0.002 | T 0.003 | C 0.002 | T 0.003 | C 0.00 | T 0.00 | C 0.00 | T 0.00 | C 0.00 | T 0.00 |

EXAMPLE 16

This example concerns the production of facecoat slurries comprising an intimate mixture of a mold-forming material and an imaging agent, molds made using such facecoat, and Ti 6-4 test bars cast using such molds to determine the effectiveness of inclusion imaging using the facecoat material, as well as the amount of α case produced by casting such test bars. This Example 16 concerns a facecoat slurry comprising calcined gadolinia/yttria. Otherwise, the facecoat slurry and mold were produced in a manner substantially identical to that of Example 1. The materials used to produce the facecoat slurry are provided below in Table 23.

TABLE 23

| MATERIALS | WEIGHT PERCENT |
|---|---|
| deionized water | 4.04 |
| tetraethyl ammonium hydroxide | 0.96 |
| titanium dioxide | 3.85 |
| latex (Dow 460 NA) | 1.93 |
| surfactant (NOPCOWET C-50) | 0.19 |
| colloidal silica (Ludox SM) | 7.70 |
| calcined gadolinia/yttria (14%/86%) | 81.22 |
| antifoaming agent (Dow 1410) | 0.14 |

Figure 2G:
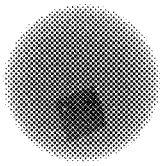
FIG. 2G is an N-ray image of an inclusion-containing test bar having a facecoat-simulating inclusion comprising cocalcined yttria and 14 weight percent gadolinia.

FIG. 2G is an N-ray image of a test bar made from a mold having the facecoat composition described above. FIG. 2G shows the presence of the inclusion.

α-case data for test bars cast as discussed in Example 16 is provided below in Table 24.

TABLE 24

| Face-coat | 1.5" | | 1.0" | | 0.5" | | 0.25" | | 0.125" | |
|---|---|---|---|---|---|---|---|---|---|---|
| | Example 16 - 1800° F. | | | | | | | | | |
| refractory flour was | C | T | C | T | C | T | C | T | C | T |
| 100% yttria | 0.005 | 0.009 | 0.005 | 0.009 | 0.005 | 0.010 | 0.002 | 0.003 | 0.001 | 0.004 |
| refractory flour was | C | T | C | T | C | T | C | T | C | T |
| yttria plus 14 wt. % gadolinia | 0.005 | 0.009 | 0.004 | 0.011 | 0.002 | 0.005 | 0.002 | 0.005 | 0.00 | 0.00 |
| | Example 16 - 700° F. | | | | | | | | | |
| refractory flour was | C | T | C | T | C | T | C | T | C | T |
| 100% yttria | 0.003 | 0.007 | 0.003 | 0.005 | 0.001 | 0.003 | 0.00 | 0.00 | 0.00 | 0.00 |
| refractory flour was | C | T | C | T | C | T | C | T | C | T |
| yttria plus 14 wt. % gadolinia | 0.003 | 0.004 | 0.001 | 0.005 | 0.00 | 0.00 | 0.00 | 0.00 | 0.00 | 0.00 |

EXAMPLE 17

This example concerns the production of facecoat slurries comprising an intimate mixture of a mold-forming material and an imaging agent, molds that have been made using such facecoat, and Ti 6-4 test bars cast using such molds to determine the effectiveness of inclusion imaging using the facecoat material, as well as the amount of α case produced by casting such test bars. This Example 17 concerns a facecoat slurry comprising calcined gadolinia/yttria. Otherwise, the facecoat slurry and mold were produced in a manner substantially identical to that of Example 1. The materials used to produce the facecoat slurry are provided below in Table 25.

TABLE 25

| MATERIALS | WEIGHT PERCENT |
|---|---|
| deionized water | 3.53 |
| tetraethyl ammonium hydroxide | 0.84 |
| titanium dioxide | 3.36 |
| latex (Dow 460 NA) | 1.68 |
| surfactant (NOPCOWET C-50) | 0.17 |
| colloidal silica (Ludox SM) | 6.72 |
| calcined gadolinia/yttria (60%/40%) | 83.62 |
| antifoaming agent (Dow 1410) | 0.08 |

Figure 2H:
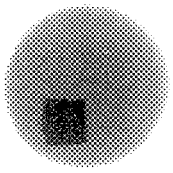
FIG. 2H is an N-ray image of an inclusion-containing test bar having a facecoat-simulating inclusion comprising cocalcined yttria and 60 weight percent gadolinia.
Figure 2I:
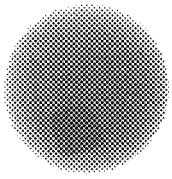
FIG. 2I is an N-ray image of an inclusion-containing test bar having a facecoat-simulating inclusion comprising cocalcined yttria and 14 weight percent samaria.

FIG. 2H is an N-ray image of a test bar made from a mold having the facecoat composition described above. FIG. 2H shows the presence of the inclusion.

α-case data for test bars cast as discussed in Example 17 is provided below in Table 26.

TABLE 26

| Face-coat | 1.5" | | 1.0" | | 0.5" | | 0.25" | | 0.125" | |
|---|---|---|---|---|---|---|---|---|---|---|
| | Example 17 - 1800° F. | | | | | | | | | |
| refractory flour was | C | T | C | T | C | T | C | T | C | T |
| 100% yttria | 0.004 | 0.008 | 0.004 | 0.007 | 0.003 | 0.007 | 0.001 | 0.003 | 0.0 | 0.00 |
| refractory flour was | C | T | C | T | C | T | C | T | C | T |
| yttria plus 60 wt. % gadolinia | 0.012 | 0.014 | 0.005 | 0.010 | 0.003 | 0.007 | 0.001 | 0.004 | 0.00 | 0.00 |
| | Example 17 - 700° F. | | | | | | | | | |
| refractory flour was | C | T | C | T | C | T | C | T | C | T |
| 100% yttria | 0.005 | 0.009 | 0.002 | 0.007 | 0.002 | 0.007 | 0.002 | 0.004 | 0.00 | 0.00 |
| refractory flour was | C | T | C | T | C | T | C | T | C | T |
| yttria plus 60 wt. % gadolinia | 0.004 | 0.006 | 0.002 | 0.003 | 0.003 | 0.003 | 0.002 | 0.003 | 0.00 | 0.00 |

EXAMPLE 18

This example concerns producing facecoat slurries comprising gadolinia as both the mold-forming material and the imaging agent and molds having such facecoat. The facecoat slurry and mold are produced in a manner substantially identical to that of Example 1. The materials for producing the facecoat slurry are provided below in Table 27.

TABLE 27

| MATERIALS | WEIGHT PERCENT |
|---|---|
| deionized water | 3.04 |
| tetraethyl ammonium hydroxide | 0.72 |
| titanium dioxide | 2.90 |
| latex (Dow 460 NA) | 1.45 |
| surfactant (NOPCOWET C-50) | 0.14 |
| colloidal silica (Ludox SM) | 5.79 |
| gadolinia (100%) | 85.88 |
| antifoaming agent (Dow 1410) | 0.08 |

Molds produced according to this Example 18 are not deemed suitable for casting parts. This apparently is due to the increased aqueous solubility of gadolinia relative to yttria. The problems encountered with this Example 18 however, likely can be addressed by taking into consideration the enhanced aqueous solubility of pure gadolinia as compared to other imaging materials, and mixtures of mold-forming agents and imaging agents.

EXAMPLE 19

This example concerns the production of facecoat slurries comprising an intimate mixture of a mold-forming material and an imaging agent, molds made using such facecoat, and Ti 6-4 test bars cast using such molds to determine the effectiveness of inclusion imaging using the facecoat material, as well as the amount of α case produced by casting such test bars. This Example 19 concerns a facecoat slurry comprising calcined samaria/yttria. Otherwise, the facecoat slurry and mold were produced in a manner substantially identical to that of Example 1. The materials used to produce the facecoat slurry are provided below in Table 28.

TABLE 28

| MATERIALS | WEIGHT PERCENT |
|---|---|
| deionized water | 4.04 |
| tetraethyl ammonium hydroxide | 0.96 |
| titanium dioxide | 3.85 |
| latex (Dow 460 NA) | 1.93 |
| surfactant (NOPCOWET C-50) | 0.19 |
| colloidal silica (Ludox SM) | 7.70 |
| calcined samaria/yttria (14%/86%) | 81.22 |
| antifoaming agent (Dow 1410) | 0.11 |

FIG. 21 is an N-ray image of a test bar made from a mold having the facecoat composition described above. FIG. 21 shows the presence of the inclusion.

α-case data for test bars cast at shell temperatures of 1,800° F. and 700° F. using shells made from the composition discussed in Example 19 is provided below in Table 29.

TABLE 29

| Face-coat | 1.5" | | 1.0" | | 0.5" | | 0.25" | | 0.125" | |
|---|---|---|---|---|---|---|---|---|---|---|
| Example 19 - 1800° F. | | | | | | | | | | |
| refractory flour was 100% yttria | C 0.004 | T 0.010 | C 0.006 | T 0.019 | C 0.003 | T 0.014 | C 0.002 | T 0.012 | C <0.001 | T 0.002 |
| refractory flour was yttria plus 14 wt. % samaria | C 0.003 | T 0.005 | C 0.006 | T 0.019 | C 0.003 | T 0.012 | C 0.002 | T 0.005 | C 0.001 | T 0.004 |
| Example 19 - 700° F. | | | | | | | | | | |
| refractory flour was 100% yttria | C 0.003 | T 0.007 | C 0.004 | T 0.007 | C 0.003 | T 0.004 | C 0.002 | T 0.005 | C <0.001 | T 0.001 |
| refractory flour was yttria plus 14 wt. % samaria | C 0.003 | T 0.012 | C 0.003 | T 0.006 | C 0.003 | T 0.012 | C <0.001 | T 0.004 | C <0.001 | T <0.001 |

EXAMPLE 20

This example concerns the production of facecoat slurries comprising an intimate mixture of a mold-forming material and an imaging agent, molds that have been made using such facecoat, and Ti 6-4 test bars cast using such molds to determine the effectiveness of inclusion imaging using the facecoat material, as well as the amount of α case produced by casting such test bars. This Example 20 concerns a facecoat slurry comprising calcined samaria/yttria. Otherwise, the facecoat slurry and mold were produced in a manner substantially identical to that of Example 1. The materials used to produce the facecoat slurry are provided below in Table 30.

TABLE 30

| MATERIALS | WEIGHT PERCENT |
|---|---|
| deionized water | 3.90 |
| tetraethyl ammonium hydroxide | 0.93 |
| titanium dioxide | 3.71 |
| latex (Dow 460 NA) | 1.86 |
| surfactant (NOPCOWET C-50) | 0.19 |
| colloidal silica (Ludox SM) | 7.43 |
| calcined samaria/yttria (27%/73%) | 81.89 |
| antifoaming agent (Dow 1410) | 0.09 |

Figure 2J:
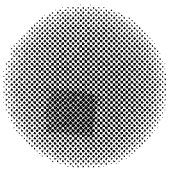
FIG. 2J is an N-ray image of an inclusion-containing test bar having a facecoat-simulating inclusion comprising cocalcined yttria and 27 weight percent samaria.

FIG. 2J is an N-ray image of a test bar made from a mold having the facecoat composition described above. FIG. 2J shows the presence of the inclusion.

α-case data for test bars cast as discussed in Example 20 is provided below in Table 31.

TABLE 31

| Face-coat | 1.5" | | 1.0" | | 0.5" | | 0.25" | | 0.125" | |
|---|---|---|---|---|---|---|---|---|---|---|
| | | | | Example 20 - 1800° F. | | | | | | |
| refractory flour was | C | T | C | T | C | T | C | T | C | T |
| 100% yttria | 0.005 | 0.010 | 0.004 | 0.005 | 0.003 | 0.005 | 0.002 | 0.005 | 0.001 | 0.00 |
| refractory flour was | C | T | C | T | C | T | C | T | C | T |
| yttria plus 27 wt. % samaria | 0.003 | 0.005 | 0.005 | 0.010 | 0.003 | 0.016 | 0.003 | 0.009 | 0.00 | 0.00 |
| | | | | Example 20 - 700° F. | | | | | | |
| refractory flour was | C | T | C | T | C | T | C | T | C | T |
| 100% yttria | 0.003 | 0.005 | 0.004 | 0.021 | 0.002 | 0.005 | 0.001 | 0.003 | 0.001 | 0.002 |
| refractory flour was | C | T | C | T | C | T | C | T | C | T |
| yttria plus 27 wt. % samaria | 0.003 | 0.009 | 0.003 | 0.005 | 0.002 | 0.011 | <0.001 | 0.004 | <0.001 | 0.003 |

EXAMPLE 21

This example concerns the production of facecoat slurries comprising an intimate mixture of a mold-forming material and an imaging agent, molds made having such facecoat, and Ti 6-4 test bars cast using such molds to determine the effectiveness of inclusion imaging using the facecoat material, as well as the amount of α case produced by casting such test bars. This Example 21 concerns a facecoat slurry comprising calcined gadolinia/yttria. Otherwise, the facecoat slurry and mold were produced in a manner substantially identical to that of Example 1. The materials used to produce the facecoat slurry are provided below in Table 32.

TABLE 32

| MATERIALS | WEIGHT PERCENT |
|---|---|
| deionized water | 3.90 |
| tetraethyl ammonium hydroxide | 0.93 |
| titanium dioxide | 3.71 |
| latex (Dow 460 NA) | 1.86 |
| surfactant (NOPCOWET C-50) | 0.19 |
| colloidal silica (Ludox SM) | 7.43 |
| calcined gadolinia/yttria (27%173%) | 81.89 |
| antifoaming agent (Dow 1410) | 0.09 |

Figure 2K:
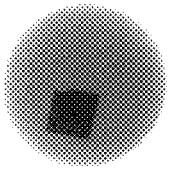
FIG. 2K is an N-ray image of an inclusion-containing test bar having a facecoat-simulating inclusion comprising cocalcined yttria and 27 weight percent gadolinia.

FIG. 2K is an N-ray image of a test bar made from a mold having the facecoat composition described above. FIG. 2K shows the presence of the inclusion.

EXAMPLE 22

This example concerns the production of facecoat slurries comprising an intimate mixture of a mold-forming material and an imaging agent, molds that have been cast using such facecoat, and Ti 6-4 test bars cast using such molds to determine the effectiveness of inclusion imaging using the facecoat material, as well as the amount of α case produced by casting such test bars. This Example 22 concerns a facecoat slurry comprising calcined gadolinia/yttria. Otherwise, the facecoat slurry and mold were produced in a manner substantially identical to that of Example 1. The materials used to produce the facecoat slurry are provided below in Table 33.

TABLE 33

| MATERIALS | WEIGHT PERCENT |
|---|---|
| deionized water | 3.77 |
| tetraethyl ammonium hydroxide | 0.90 |
| titanium dioxide | 3.59 |
| latex (Dow 460 NA) | 1.80 |
| surfactant (NOPCOWET C-50) | 0.18 |
| colloidal silica (Ludox SM) | 7.18 |
| calcined gadolinia/yttria (39%/61%) | 82.49 |
| antifoaming agent (Dow 1410) | 0.09 |

Figure 2L:
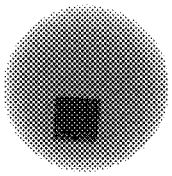
FIG. 2L is an N-ray image of an inclusion-containing test bar having a facecoat-simulating inclusion comprising cocalcined yttria and 39 weight percent gadolinia.

FIG. 2L is an N-ray image of a test bar made from a mold having the facecoat composition described above. FIG. 2L shows the presence of the inclusion.

EXAMPLE 23

This example concerns the production of facecoat slurries comprising an intimate mixture of a mold-forming material and an imaging agent, molds made having such facecoat, and Ti 6-4 structural castings made using such molds to determine the effectiveness of inclusion imaging agents using the facecoat material, as well as the amount of α case produced by casting such a part. This Example 23 concerns a facecoat slurry comprising calcined gadolinia/yttria. Otherwise, the facecoat slurry and molds was produced in a manner substantially identical to that of Example 1. The materials used to produce the facecoat slurry are provided in Table 23. α case results from four locations are shown in Table 34.

TABLE 34

| Location | C | I |
|---|---|---|
| 1 | 0.004 | 0.004 |
| 2 | 0.002 | 0.006 |
| 3 | 0.004 | 0.006 |
| 4 | 0.008 | 0.015 |

Figure 3:
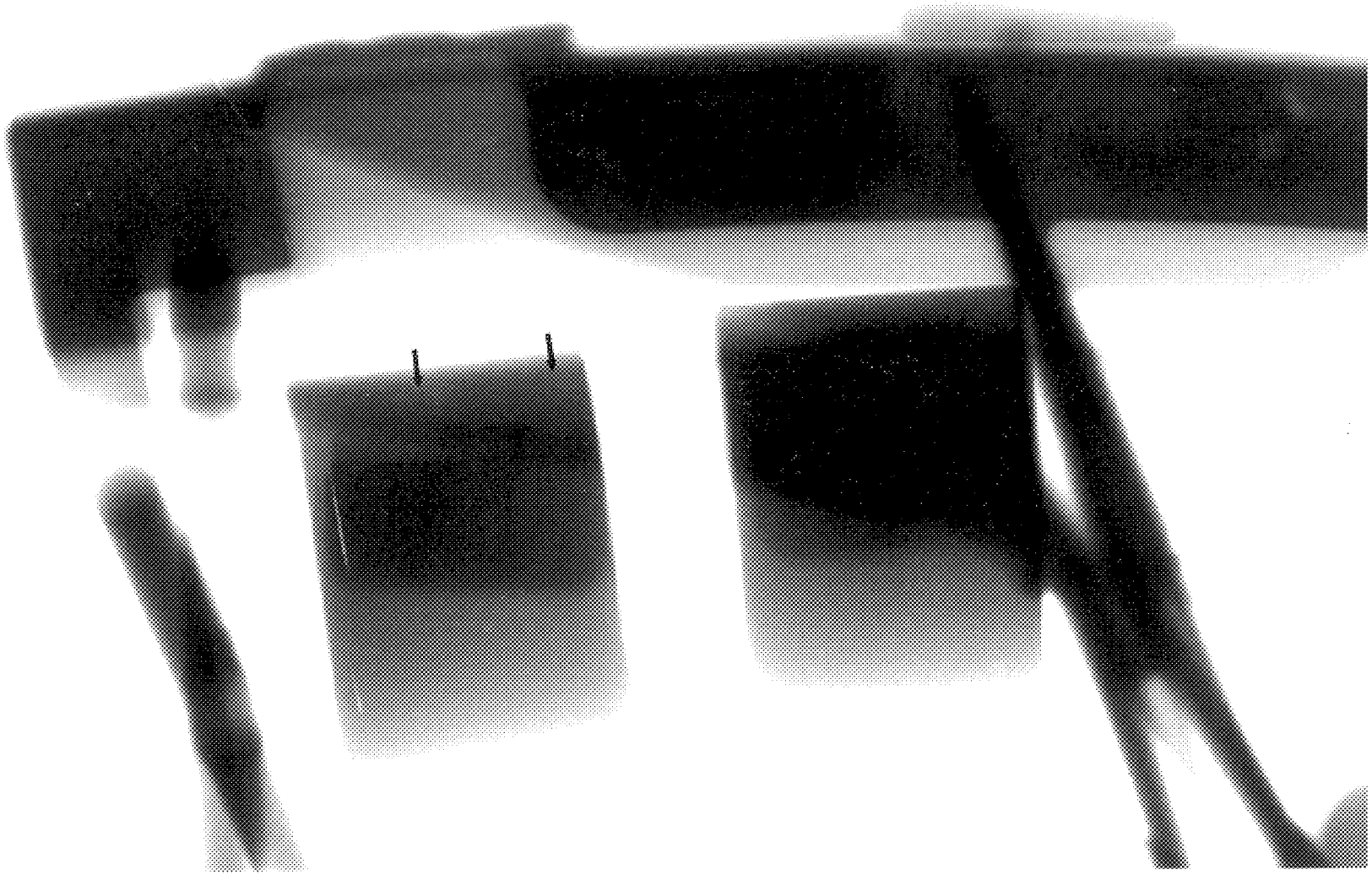
FIG. 3 is an N-ray image of an experimental casting made using a mold having a facecoat comprising yttria and 14 weight percent gadolina.

Non-destructive testing using N-ray analysis revealed the presence of two inclusions (FIG. 3) in a section thickness of about 1 inch, the inclusions having observed lengths of about 0.025 inch and 0.050 inch. Standard production techniques for inspection using both X-ray analysis and ultrasonic inspection did not reveal these inclusions. This example therefore demonstrates (1) the ability of the gadolinia-doped facecoat to produce castings having acceptable α case levels, and (2) the benefits of using N-ray analysis to detect inclusions, which otherwise would go undetected using conventional techniques developed prior to the present invention.

IV. Infiltration Method for Forming Molds Comprising Imaging Agents

The method described above involves forming a mold having at least a facecoat that includes one or more imaging agents. An alternative method for forming investment casting molds comprising imaging agents might be to first form a mold substantially as described above, and thereafter infiltrate the mold with a suitable imaging agent. In this method all particles, including stucco would be coated with the imaging agent.

One method for infiltrating the mold would be to form the mold in the conventional manner to have an internal cavity in the shape of the desired article. A solution, typically but not necessarily an aqueous solution, of an imaging agent would then be placed inside the cavity for a sufficient period of time to substantially uniformly infiltrate the desired portion of the mold. For example, a solution of a salt comprising oxidized gadolinium, such as a nitrate, sulfate or halide salt, would be placed inside the cavity.

A second method for infiltrating the mold would be to immerse a pattern having at least a facecoat applied thereto into an aqueous or non-aqueous solution comprising an imaging agent to infiltrate at least the facecoat with the imaging agent. The pattern could be immersed in imaging agent solutions after application of only the facecoat, after application of the facecoat and then again after application of at least one backup layer, after the facecoat and then again plural times after each application of subsequent backup layers, or after application of each and every layer of the mold.

The "infiltration" should provide suitable results. However, it currently is believed that forming molds comprising an intimate mixture of a mold-forming material or materials and an imaging agent or agent in at least the facecoat provides a preferred process.

The present invention has been described with respect to certain preferred embodiments. However, the present invention should not be limited to the particular features described. Instead, the scope of the invention should be determined by the following claims.

We claim:

1. A method for determining whether a metal or metal alloy article has inclusions, comprising:

providing a cast metal or metal alloy article made using a casting mold comprising an imaging agent which includes a material selected from the group consisting of boron, neodymium, samarium, europium, gadolinium, dysprosium, holmium, lutetium, iridium, physical mixtures thereof and chemical mixtures thereof, the imaging agent being used in amounts sufficient for imaging inclusions; and determining whether the article has inclusions by N-ray analysis.

2. The method according to claim 1 where the casting mold is an investment casting mold.

3. The method according to claim 2 where the investment casting mold includes an imaging agent distributed substantially uniformly throughout at least a facecoat.

4. The method according to claim 2 where the mold further includes at least one backup layer comprising an imaging agent.

5. The method according to claim 1 where the imaging agent is a metal salt, a metal oxide, an intermetallic, a boride, or mixtures thereof.

6. The method according to claim 1 where a linear attenuation coefficient of the article and a linear attenuation coefficient of the imaging agent are sufficiently different to allow N-ray imaging of the inclusion throughout the article.

7. The method according to claim 1 wherein the facecoat comprises substantially completely gadolinia as both the imaging agent and as a mold refractory material.

8. The method according to claim 1 where the imaging agent includes a material selected from the group consisting of dysprosium, samarium, gadolinium, physical mixtures thereof and chemical mixtures thereof.

9. A method for casting a metal or metal alloy article, comprising:

providing a casting mold comprising an N-ray imaging agent which includes a material selected from the group consisting of boron, neodymium, samarium, europium, gadolinium, dysprosium, holmium, lutetium, iridium, physical mixtures thereof and chemical mixtures thereof;

casting a metal or metal alloy article using the casting mold; and determining whether the article has inclusions by at least N-ray analysis.

10. The method according to claim 9 where determining whether the article has inclusions comprises analyzing N-ray images.

11. The method according to claim 9 where determining whether the article has inclusions comprises analyzing the article for inclusions by N-ray analysis.

12. A method for analyzing a cast metal or metal alloy article for inclusions, comprising:

casting a metal or metal alloy article using a mold having a facecoat comprising an imaging agent distributed substantially uniformly throughout in amounts sufficient for imaging inclusions, the imaging agent including a material selected from the group consisting of boron, neodymium, samarium, europium, gadolinium, dysprosium, holmium, lutetium, iridium, physical mixtures thereof and chemical mixtures thereof; and analyzing the article for inclusions by N-ray analysis.

13. The method according to claim 12 where the mold is an investment casting mold, and the imaging agent is distributed substantially uniformly in at least a facecoat layer.

14. The method according to claim 12 where the step of analyzing further comprises X-ray analysis.

15. The method according to claim 13 where the mold further includes at least one backup layer comprising an imaging agent.

16. The method according to claim 12 where the article comprises a titanium or a titanium alloy and the facecoat further comprises a refractory material.

17. The method according to claim 16 where the refractory material is yttria, zirconia, alumina, calcia, silica, zircon titania, tungsten, physical mixtures thereof, and chemical mixtures thereof.

18. The method according to claim 16 where the refractory material is yttria or zirconia.

19. The method according to claim 18 where the imaging agent is gadolinia.

20. The method according to claim 12 where a facecoat slurry used to deposit the facecoat comprises from about 1 to about 100 weight percent imaging agent.

21. The method according to claim 12 where a facecoat slurry used to deposit the facecoat comprises from about 1 to about 65 weight percent imaging agent.

22. The method according to claim 12 where a facecoat slurry used to deposit the facecoat comprises from about 2 to about 25 weight percent imaging agent.

23. The method according to claim 12 where the facecoat comprises an intimate mixture of a refractory material and the imaging agent.

24. The method according to claim 12 where the facecoat comprises intimately mixed imaging agents.

25. The method according to claim 12 where the facecoat comprises intimately mixed refractory materials.

26. The method according to claim 12 where the article comprises titanium or a titanium alloy and the facecoat comprises yttria cocalcined with gadolinia.

27. The method according to claim 2 where the facecoat comprises a refractory material and plural imaging agents.

28. The method according to claim 27 where the refractory material is yttria and one of the plural imaging agents is gadolinia.

29. A method for analyzing a cast metal or metal alloy article for mold-derived inclusions, comprising:

forming an aqueous or non-aqueous facecoat slurry comprising an inclusion imaging agent, the imaging agent including a material selected from the group consisting of boron, neodymium, samarium, europium, gadolinium, dysprosium, holmium, lutetium, iridium, physical mixtures thereof and chemical mixtures thereof;

applying the facecoat slurry to a pattern to form a mold facecoat comprising the imaging agent distributed substantially uniformly throughout in amounts sufficient for imaging inclusions;

forming an investment casting mold having the facecoat;

casting a metal or metal alloy article using the mold; and analyzing the article for inclusions using N-ray analysis.

30. The method according to claim 29 where the step of analyzing further comprises X-ray analysis.

31. The method according to claim 29 where at least one of the backup layers includes an imaging agent.

32. The method according to claim 29 where the imaging agent is a metal salt, a metal oxide, an intermetallic, a boride, or mixtures thereof.

33. The method according to claim 29 where the article comprises a titanium or a titanium alloy and the facecoat further comprises a refractory material.

34. The method according to claim 33 where the refractory material is yttria.

35. The method according to claim 29 where a facecoat slurry used to deposit the facecoat comprises from about 1 to about 100 weight percent imaging agent.

36. The method according to claim 29 where a facecoat slurry used to deposit the facecoat comprises from about 2 to about 25 weight percent imaging agent.

37. The method according to claim 29 where a facecoat slurry used to deposit the facecoat comprises from about 2 to about 25 weight percent imaging agent.

38. The method according to claim 37 where the imaging agent is gadolinia.

39. The method according to claim 29 where the step of forming an aqueous or non-aqueous facecoat slurry first comprises forming an intimate mixture of a refractory material and the imaging agent and thereafter forming the slurry.

40. The method according to claim 39 where the article comprises titanium or a titanium alloy and the facecoat comprises yttria cocalcined with gadolinia.

41. The method according to claim 29 where the facecoat comprises a refractory material and plural imaging agents.

42. The method according to claim 41 where the refractory material is yttria and one of the plural imaging agents is gadolinia.

43. The method according to claim 29 where at least a portion of the metal or metal alloy article has a thickness of greater than about 2 inches.

44. The method according to claim 29 where the difference between a linear attenuation coefficient of the article and a linear attenuation coefficient of the imaging agent is sufficient to allow imaging of the inclusion throughout the article.

45. A method for analyzing a titanium or titanium alloy article produced by investment casting for inclusions, comprising:

forming an aqueous or non-aqueous investment casting facecoat slurry comprising an intimate mixture of a mold-forming material and an imaging agent in an amount sufficient to allow imaging of inclusions in the article, the imaging agent including a material selected from the group consisting of boron, neodymium, samarium, europium, gadolinium,,dysprosium, holmium, lutetium, iridium, physical mixtures thereof and chemical mixtures thereof;

applying the slurry to a pattern to form a mold facecoat comprising the intimate mixture of the mold-forming material and the imaging agent distributed substantially uniformly throughout in amounts sufficient for imaging inclusions wherein a linear attenuation coefficient of the article and a linear attenuation coefficient of the imaging agent are sufficiently different to allow imaging of the inclusion throughout the article by N-ray analysis;

serially applying plural backup layers to the pattern and thereafter firing the pattern to form a mold for investment casting;

casting a titanium or titanium alloy article using the mold; and analyzing the article for mold inclusions by N-ray analysis.

46. The method according to claim 45 where the step of analyzing further comprises X-ray analysis.

47. The method according to claim 45 where at least one backup layer also comprises an imaging agent.

48. The method according to claim 45 where the imaging agent is a metal salt, a metal oxide, an intermetallic, a boride, or mixtures thereof.

49. The method according to claim 45 where the mold-forming material is yttria and the imaging agent is gadolinia.

50. The method according to claim 49 where the facecoat comprises yttria cocalcined with gadolinia.

51. The method according to claim 45 where the facecoat comprises a refractory material and plural imaging agents.

52. The method according to claim 51 where the refractory material is yttria and one of the plural imaging agents is gadolinia.

53. A method for analyzing investment cast articles for inclusions, comprising:

placing a solution of at least one imaging agent inside a cavity of an investment casting mold, the imaging agent including a material selected from the group consisting of boron, neodymium, samarium, europium, gadolinium, dysprosium, holmium, lutetium, iridium, physical mixtures thereof and chemical mixtures thereof;

allowing the solution to remain in the cavity for a sufficient period of time to infiltrate at least the facecoat of the mold;

removing the solution from the cavity;

casting a metal or metal alloy article using the mold; and analyzing the article for mold inclusions by N-ray imaging.

54. The method according to claim 53 where the imaging agent comprises gadolinium.

55. The method according to claim 54 where the metal or metal alloy is titanium or a titanium alloy, and the facecoat comprises yttria.

56. The method according to claim 53 and further comprising analyzing the article for inclusions by X-ray imaging.

57. The method according to claim 53 where the solution comprises plural imaging agents.

58. A method for detecting inclusions in investment castings, comprising:

forming an investment casting mold facecoat about a pattern;

infiltrating at least a portion of the facecoat using an aqueous or non-aqueous composition comprising at least one imaging agent comprising a material selected from the group consisting of boron, neodymium, samarium, europium, gadolinium, dysprosium, holmium, lutetium, iridium, physical mixtures thereof and chemical mixtures thereof;

casting a metal or metal alloy article using an investment casting mold having the facecoat; and detecting inclusions by N-ray imaging.

59. The method according to claim 58 and farther including the steps of:

forming plural mold backup layers about the pattern; and infiltrating at least one of the plural mold backup layers with the solution of the imaging agent.

60. The method according to claim 59 and further including the steps of:

forming plural mold backup layers about the pattern; and infiltrating the plural mold backup layers with the solution of the imaging agent.

61. The method according to claim 59 where the step of infiltrating comprises immersing at least a portion of the pattern having the facecoat into an aqueous or non-aqueous solution comprising the imaging agent for a period of time sufficient to infiltrate the facecoat with imaging agent.

* * * * *